US009724273B2

(12) United States Patent
Brown

(10) Patent No.: US 9,724,273 B2
(45) Date of Patent: Aug. 8, 2017

(54) PORTABLE SPITTOON DEVICE

(71) Applicant: Andre Brown, Philadelphia, PA (US)

(72) Inventor: Andre Brown, Philadelphia, PA (US)

( * ) Notice: Subject to any disclaimer, the term of this patent is extended or adjusted under 35 U.S.C. 154(b) by 276 days.

(21) Appl. No.: 14/587,231

(22) Filed: Dec. 31, 2014

(65) Prior Publication Data

US 2016/0184187 A1 Jun. 30, 2016

(51) Int. Cl.
*A61J 19/00* (2006.01)

(52) U.S. Cl.
CPC ..... *A61J 19/00* (2013.01)

(58) Field of Classification Search
CPC ..... A61J 19/00
USPC ..... 4/258, 267, 283
See application file for complete search history.

(56) References Cited

U.S. PATENT DOCUMENTS 3,629,879 A 12/1971 Forst
4,162,547 A 7/1979 Jenkins
4,503,572 A 3/1985 Dawson
5,396,664 A 3/1995 King, Jr.
6,718,563 B1 4/2004 Kreiensieck
7,066,322 B2 6/2006 Wilson
D544,167 S 6/2007 Dukic, Jr. et al.
2006/0101564 A1* 5/2006 Powdermaker ..... A61J 19/00 4/259
2007/0277299 A1 12/2007 Kroon
2008/0249488 A1* 10/2008 Quinones ..... A61J 19/00 604/317
2012/0193265 A1 8/2012 Patel et al.

* cited by examiner

*Primary Examiner* — Tuan N Nguyen

(57) ABSTRACT

A portable spittoon device for cleanly containing spit from chewing tobacco in a portable container. The device includes a bottom wall and a perimeter wall defining an interior space. A funnel having an open top end and an open bottom end is couplable to the perimeter wall such that the funnel extends downwardly from an opening into the interior space. The funnel extends away from the perimeter wall wherein the funnel is configured for inhibiting spit within the interior space from passing back out through the opening. A lid is couplable to the funnel such that the interior space is enclosed and sealed by the funnel and the lid preventing spit in the interior space from passing out of the interior space. A base wall may define a compartment under the bottom wall.

6 Claims, 4 Drawing Sheets

PORTABLE SPITTOON DEVICE

BACKGROUND OF THE DISCLOSURE

Field of the Disclosure

The disclosure relates to spittoon devices and more particularly pertains to a new spittoon device for cleanly containing spit from chewing tobacco in a portable container.

Summary of the Disclosure

An embodiment of the disclosure meets the needs presented above by generally comprising a bottom wall and a perimeter wall defining an interior space. A funnel having an open top end and an open bottom end is couplable to the perimeter wall such that the funnel extends downwardly from an opening into the interior space. The funnel extends away from the perimeter wall wherein the funnel is configured for inhibiting spit within the interior space from passing back out through the opening. A lid is couplable to the funnel such that the interior space is enclosed and sealed by the funnel and the lid preventing spit in the interior space from passing out of the interior space. A base wall may define a compartment under the bottom wall.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
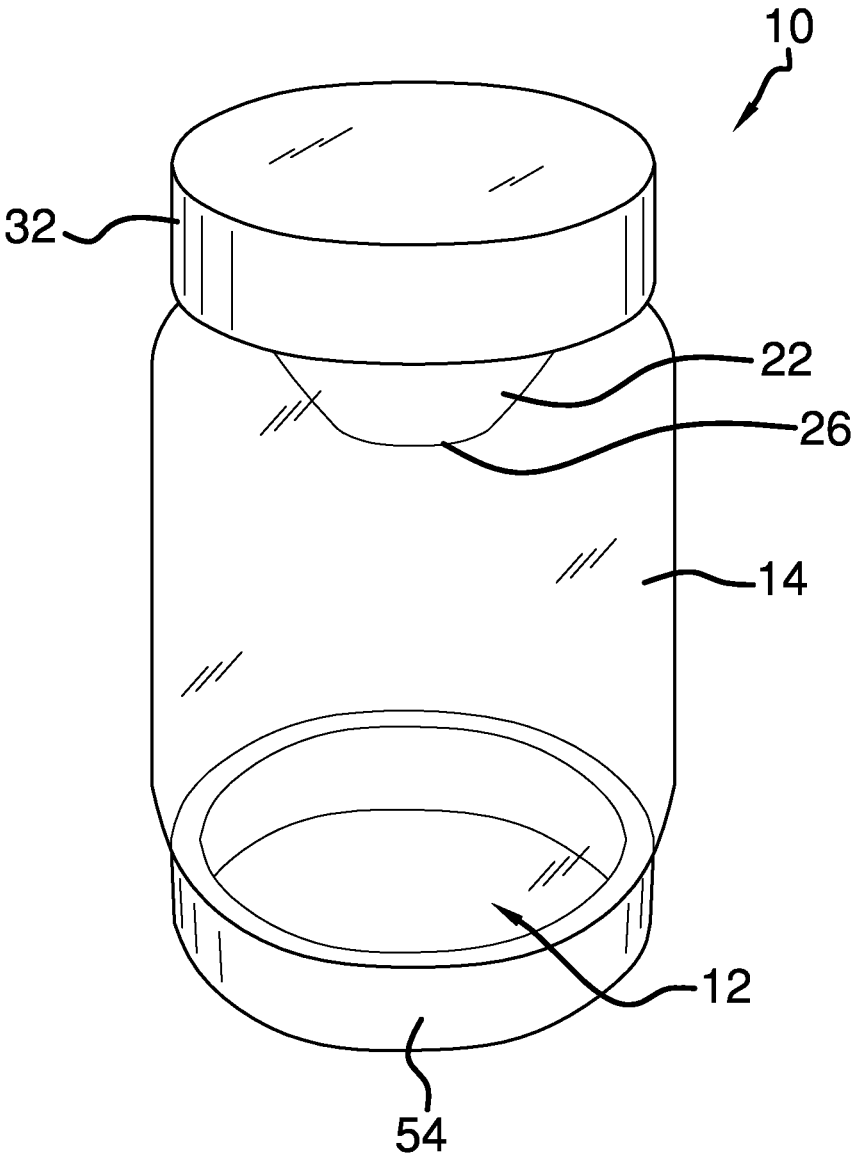
FIG. 1 is a top front side perspective view of a portable spittoon device according to an embodiment of the disclosure.
Figure 3:
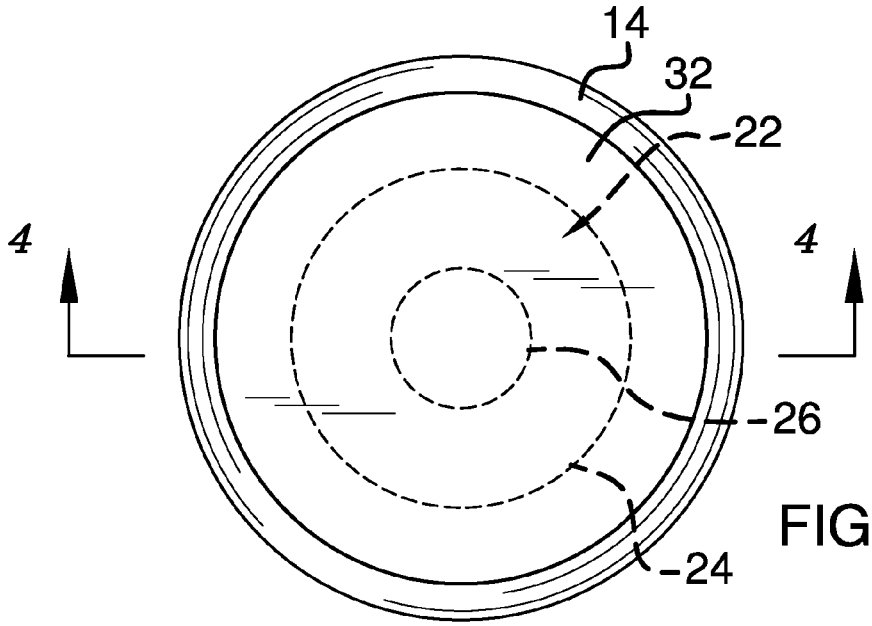
FIG. 3 is a side view of an embodiment of the disclosure.
Figure 2:
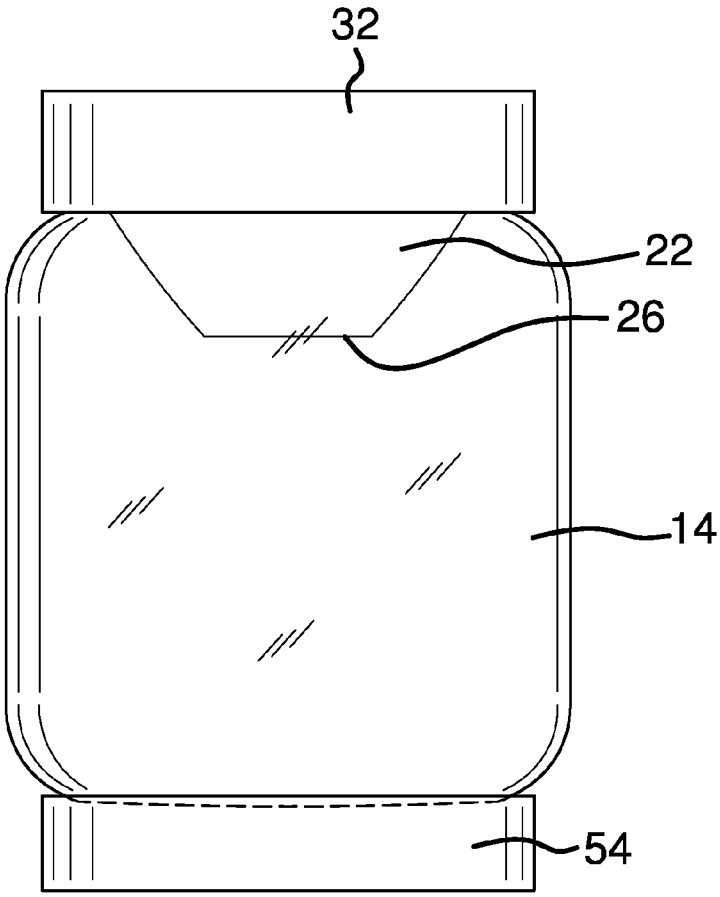
FIG. 2 is a top view of an embodiment of the disclosure.
Figure 4:
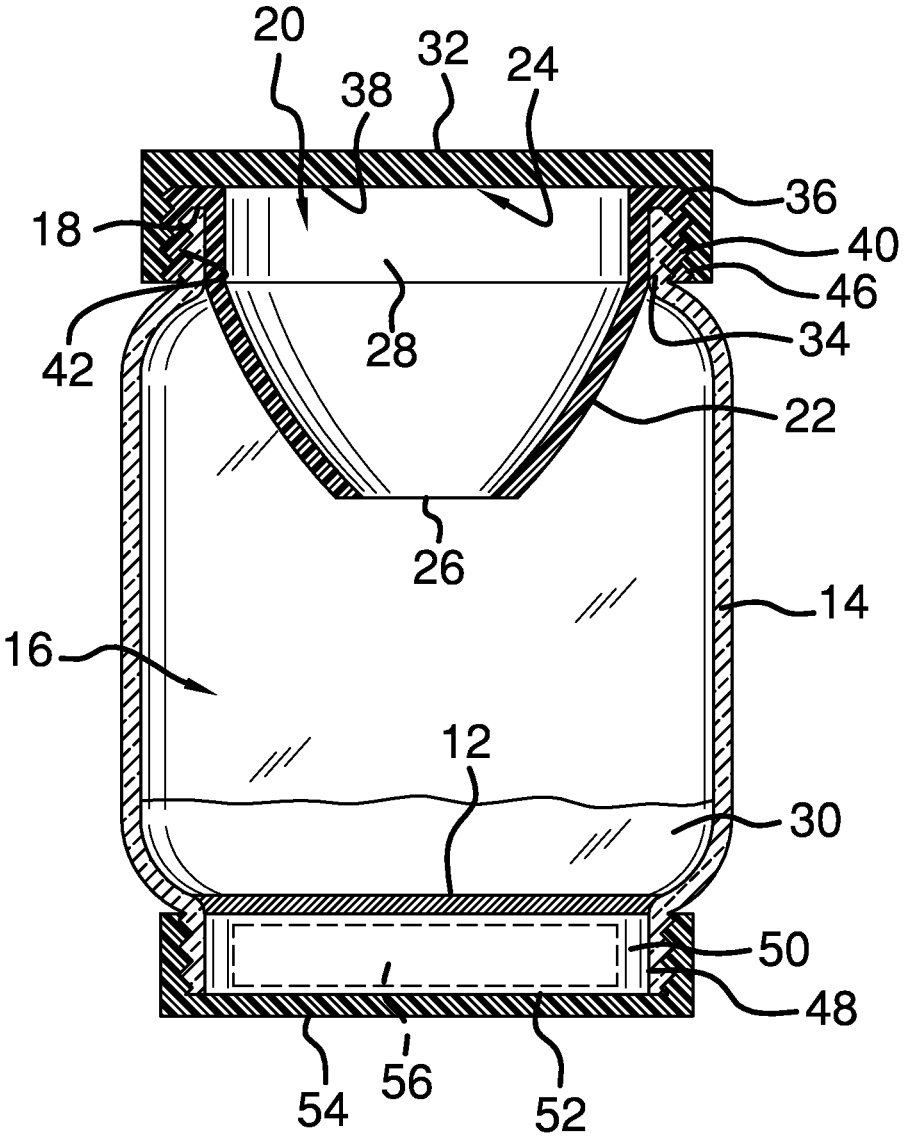
FIG. 4 is a cross-sectional view of an embodiment of the disclosure taken along line 4-4 of FIG. 2.
Figure 5:
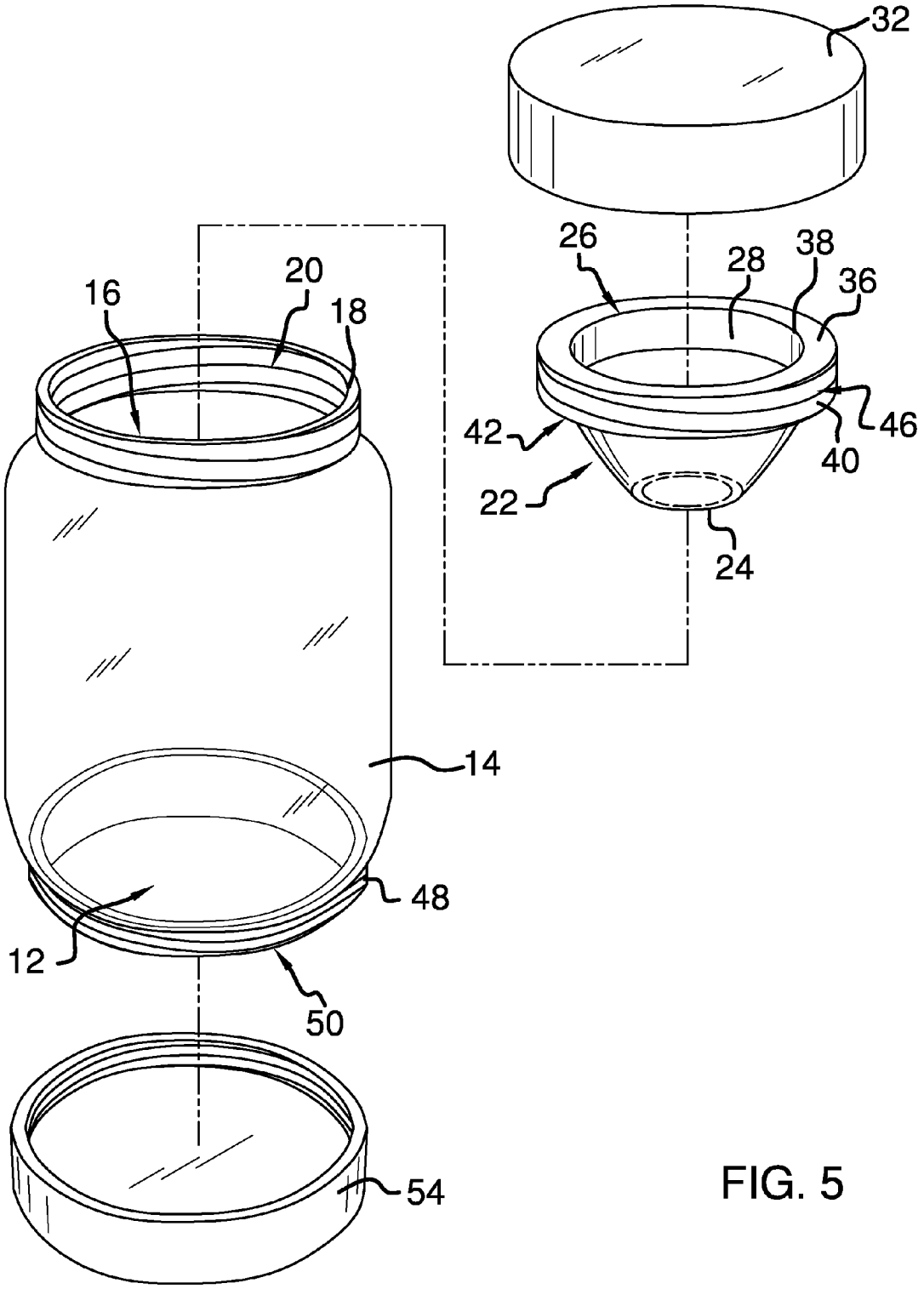
FIG. 5 is an exploded top front side perspective view of an embodiment of the disclosure.

With reference now to the drawings, and in particular to FIGS. 1 through 5 thereof, a new spittoon device embodying the principles and concepts of an embodiment of the disclosure and generally designated by the reference numeral 10 will be described.

As best illustrated in FIGS. 1 through 5, the portable spittoon device 10 generally comprises a bottom wall 12 and a perimeter wall 14 coupled to and extending upwardly from the bottom wall 12 to define an interior space 16. An upper edge 18 of the perimeter wall 14 defines an opening 20 into the interior space 16. A funnel 22 has an open top end 24 and an open bottom end 26. The funnel 22 tapers between the open top end 24 and the open bottom end 26. An uppermost section 28 of the funnel may be straight. The funnel 22 is couplable to the perimeter wall 14 such that the funnel 22 extends downwardly from the opening 20 and into the interior space 16 away from the perimeter wall 14. Thus, the funnel 22 is configured for inhibiting spit 30 within the interior space 16 from passing back out through the opening 20. A lid 32 is couplable to the funnel 22 such that the lid 32 covers the open top end 24 of the funnel 22. The interior space 16 is enclosed by and sealed by the funnel 22 and the lid 32 such that the lid 32 is configured for preventing the spit 30 in the interior space 16 from passing out of the interior space 16 through the opening 20 and out of the interior space 16 through the funnel 22.

A top portion 34 of the perimeter wall 14 is threaded. A connection flange 36 is coupled to and extends from an uppermost edge 38 of the funnel 22. The connection flange 36 has a peripheral wall 40 extending around the funnel 22. An inwardly facing surface 42 of the peripheral wall 40 is threaded and complementary to the top portion 34 of the perimeter wall 14. Thus, the funnel 22 is threadingly engageable to the perimeter wall 14. An outwardly facing surface 46 of the peripheral wall 14 is also threaded. The lid 32 is threaded and complementary to the outwardly facing surface 46 of the peripheral wall 40 wherein the lid 32 is threadingly engageable to the funnel 22.

A base wall 48 is coupled to and extends downwardly from the bottom wall 12. The base wall 48 defines a compartment 50 under the bottom wall 12. A distal edge 52 of the base wall 48 is planar and parallel to the bottom wall 12 allowing the base wall 48 to support the bottom wall 12 in parallel spaced relationship to a supporting surface. The upper edge 18 of the perimeter wall 14 is parallel to the bottom wall 12 to inhibit spillage from the interior space 16 when the base wall 48 is positioned on the supporting surface. A cap 54 is removably couplable to the base wall 48 such that the cap 54 is configured for holding a chewing tobacco container 56 within the compartment 50. The cap 54 threadingly engages the base wall 48. The cap 54 is solid such that the cap 54 fully encloses the compartment 50 inhibiting environmental communication with said compartment wherein the cap 54 is configured to preserve freshness of chewing tobacco positioned in the compartment 50.

In use, the lid 32 is removed to allow a user to spit through the opening 20 to collect spit in the interior space 20. The funnel 22 inhibits spit from leaving the interior space 20 in the even the device 10 is tilted or falls over. Chewing tobacco is stored in the compartment 50 and accessible by removing the cap 54. The lid 32 is attached to the funnel 22 and perimeter wall 14 to seal the interior space 16 allowing the device 10 to be transported without spilling spit from the interior space 16. The lid 32 and funnel 22 may be removed from the perimeter wall 14 and each other to facilitate disposal of collected spit and used tobacco and cleaning of the device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable spittoon device comprising:

a bottom wall;

a perimeter wall coupled to and extending upwardly from said bottom wall to define an interior space, an upper edge of said perimeter wall defining an opening into said interior space;

a funnel having an open top end and an open bottom end, said funnel being couplable to said perimeter wall such that said funnel extends downwardly from said opening and into said interior space away from said perimeter wall wherein said funnel is configured for inhibiting spit within said interior space from passing back out through said opening;

a lid, said lid being couplable to said funnel such that said lid covers said open top end of said funnel such that said interior space is enclosed and sealed by said funnel and said lid such that said lid is configured for preventing the spit in said interior space from passing out of said interior space through said funnel;

a top portion of said perimeter wall being threaded;

a connection flange coupled to and extending from an uppermost edge of said funnel, said connection flange having a peripheral wall extending around funnel;

an inwardly facing surface of said peripheral wall being threaded and complementary to said top portion of said perimeter wall wherein said funnel is threadingly engageable to said perimeter wall;

an outwardly facing surface of said peripheral wall being threaded; and said lid being threaded and complementary to said outwardly facing surface of said peripheral wall wherein said lid is threadingly engageable to said funnel.

2. The device of claim 1, further comprising:

a base wall coupled to and extending downwardly from said bottom wall, said base wall defining a compartment under said bottom wall; and a cap being removably couplable to said base wall such that said cap is configured for holding a chewing tobacco container within said compartment.

3. The device of claim 2, further comprising said cap threadingly engaging said base wall.

4. The device of claim 2, further comprising said cap being solid such that said cap fully encloses said compartment.

5. A portable spittoon device comprising:

a bottom wall;

a perimeter wall coupled to and extending upwardly from said bottom wall to define an interior space, an upper edge of said perimeter wall defining an opening into said interior space;

a lid, said lid being couplable to said container such that said lid covers said opening into said interior space such that said interior space is enclosed and sealed by said lid such that said lid is configured for preventing spit in said interior space from passing out of said interior space through said opening;

a base wall coupled to and extending downwardly from said bottom wall, said base wall defining a compartment under said bottom wall;

a cap being removably couplable to said base wall such that said cap is configured for holding a chewing tobacco container within said compartment;

a funnel having an open top end and an open bottom end, said funnel being couplable to said perimeter wall such that said funnel extends downwardly from said opening and into said interior space away from said perimeter wall wherein said funnel is configured for inhibiting spit within said interior space from passing back out through said opening;

a top portion of said perimeter wall being threaded;

a connection flange coupled to and extending from an uppermost edge of said funnel, said connection flange having a peripheral wall extending around funnel;

an inwardly facing surface of said peripheral wall being threaded and complementary to said top portion of said perimeter wall wherein said funnel is threadingly engageable to said perimeter wall;

an outwardly facing surface of said peripheral wall being threaded; and said lid being threaded and complementary to said outwardly facing surface of said peripheral wall wherein said lid is threadingly engageable to said funnel such that said lid is couplable to said perimeter wall when said funnel is coupled to said perimeter wall.

6. A portable spittoon device comprising:

a bottom wall;

a perimeter wall coupled to and extending upwardly from said bottom wall to define an interior space, an upper edge of said perimeter wall defining an opening into said interior space;

a funnel having an open top end and an open bottom end, said funnel being couplable to said perimeter wall such that said funnel extends downwardly from said opening and into said interior space away from said perimeter wall wherein said funnel is configured for inhibiting spit within said interior space from passing back out through said opening; and a lid, said lid being couplable to said funnel such that said lid covers said open top end of said funnel such that said interior space is enclosed and sealed by said funnel and said lid such that said lid is configured for preventing the spit in said interior space from passing out of said interior space through said funnel;

a top portion of said perimeter wall being threaded;

a connection flange coupled to and extending from an uppermost edge of said funnel, said connection flange having a peripheral wall extending around funnel, an inwardly facing surface of said peripheral wall being threaded and complementary to said top portion of said perimeter wall wherein said funnel is threadingly engageable to said perimeter wall, an outwardly facing surface of said peripheral wall being threaded said lid being threaded and complementary to said outwardly facing surface of said peripheral wall wherein said lid is threadingly engageable to said funnel;

a base wall coupled to and extending downwardly from said bottom wall, said base wall defining a compartment under said bottom wall; and a cap being removably couplable to said base wall such that said cap is configured for holding a chewing tobacco container within said compartment, said cap threadingly engaging said base wall, said cap being solid such that said cap fully encloses said compartment.

* * * * *